US006955109B1

(12) United States Patent
Huang

(10) Patent No.: US 6,955,109 B1
(45) Date of Patent: Oct. 18, 2005

(54) ELECTRIC PUNCH

(76) Inventor: Chien Kai Huang, No. 136, Tsu Chiang Road, Chang Hua City (TW)

( * ) Notice: Subject to any disclaimer, the term of this patent is extended or adjusted under 35 U.S.C. 154(b) by 0 days.

(21) Appl. No.: 10/885,091

(22) Filed: Jul. 7, 2004

(51) Int. Cl.[7] ..... B26F 1/14
(52) U.S. Cl. ..... 83/549; 83/618; 83/628; 83/691
(58) Field of Search ..... 83/618, 628, 859, 83/635, 613, 620, 860, 636, 549, 687, 691

(56) References Cited

U.S. PATENT DOCUMENTS

| | | | | |
|---|---|---|---|---|
| 2,327,646 | A * | 8/1943 | Hutchinson | 83/550 |
| 5,628,502 | A * | 5/1997 | Amarakoon | 270/58.07 |
| 6,269,721 | B1 * | 8/2001 | Tseng | 83/618 |
| 6,374,715 | B1 * | 4/2002 | Takatsuka | 83/620 |
| 2002/0139232 | A1 * | 10/2002 | Hsu | 83/549 |
| 2003/0150315 | A1 * | 8/2003 | Lin | 83/628 |
| 2003/0160094 | A1 * | 8/2003 | Ko | 234/102 |

* cited by examiner

*Primary Examiner*—Allan N. Shoap
*Assistant Examiner*—Phong Nguyen
(74) *Attorney, Agent, or Firm*—Bacon & Thomas, PLLC

(57) ABSTRACT

An electric punch includes a plurality of pushing units mounted to the shaft which is driven by a motor. Each pushing unit includes a ring rotatably received in a pushing member and each ring has an eccentric polygonal hole through which the shaft fixedly extends. The pushing members are received in movable frames and two opposite sides of each pushing member are slidably in contact with two upright walls of the movable frame corresponding thereto. A plurality of punch units each include a punch frame and a punch member whose front end is used to punch sheets and rear end of the punch member extends out from the punch frame and is in contact with the pushing member. The pushing member is moved up and down in the movable frame by the rotation of the rings when the shaft rotates and the movable frames move to push the punch members to punch the sheets.

4 Claims, 9 Drawing Sheets

ELECTRIC PUNCH

FIELD OF THE INVENTION

The present invention relates to an electric punch wherein the pushing members are normally in contact with the punching heads so as to reduce noise and wearing when punching.

BACKGROUND OF THE INVENTION

A conventional paper punch is disclosed in FIGS. 5 and 6, and generally includes a case 60 with a floor board 61 through which three slots 62 are defined and three movable frames 80 are movably connected to the floor board 61 by connecting a plate 82 located an outside of the floor board 61 to the respective one of the movable frames 80 by screws. Each movable frame 80 includes front and rear upright walls 801 and a recess 81 is defined in the front upright wall 801. Three punch units 90 are connected on the floor board 61 and located in front of the three movable frames 80. Each punch unit 90 includes a punch frame 91 and a punch member 92 extends through three upright walls on the punch member 92. A spring 93 is mounted to the punch member 92 and a slot 94 defined between the first and second upright walls so as to receive sheets to be punched. An rear end of the punch member 92 extends through the third upright wall of the punch frame 91 corresponding thereto and movably engaged with the recess 81 in the movable frame 80 corresponding thereto. A driving mechanism 70 includes a shaft 75 rotatably connected between two sidewalls of the case 60 and an active gear 74 is connected to one of two ends of the shaft 75. A motor 71 is located in the case 60 and includes an output shaft 711 to which a first passive gear 72 is connected. A second passive gear 73 is engaged between the first passive gear 72 and the active gear 74. A plurality of rings 76 each have an eccentric hole 761 defined therethrough and the shaft 75 extends through the eccentric holes 761 of the rings 76 by clips 77. The eccentric holes 761 are not in aligned with each other and each ring 76 further includes multiple pushing surfaces 762 defined in a periphery thereof and is located in one of the movable frames 80. A gap is defined between the ring 76 and the rear end of the punch member 92.

Referring to FIGS. 7A to 7D, when the shaft 75 is rotated by activating the motor 71, the rings 76 are rotated with the shaft 75 and one of the pushing surfaces 762 of each of the rings 76 pushes the punch member 92 in a pre-set sequence to punch the sheets in the slot 94 in the three punch frames 91. This arrangement can prolong the term of use of the punch members 92 and the punching action is more effective. Nevertheless, when the pushing surfaces 762 of the rings 76 impact the punch members 92, noise is generated and wearing between the pushing surfaces 762 of the rings 76 and the punch members 92.

The present invention intends to provide an electric punch wherein the rings are rotatably received in rectangle pieces which are movably engaged between the two upright walls of the movable frames, the rectangle pieces can only movable in an upright direction so that no impact between the rectangle pieces and the two upright walls of the movable frames.

SUMMARY OF THE INVENTION

The present invention relates to an electric punch that includes a case with a motor connected thereto so as to drive a shaft rotatably connected between two side walls of the case. A plurality of pushing units are mounted to the shaft and each pushing unit includes a ring rotatably received in a pushing member. Each ring has a polygonal hole through which the shaft fixedly extends. A plurality of movable frames each include two upright walls and movably connected to the case. A plurality of punch units each include a punch frame and a punch member whose front end is used to punch sheets and rear end of the punch member extends out from the punch frame and movably engaged with a recess of the movable frame and is in contact with the pushing member. The pushing member is moved up and down in the movable frame by the rotation o the rings when the shaft rotates while the movable frames move to push the punch members to punch the sheets.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
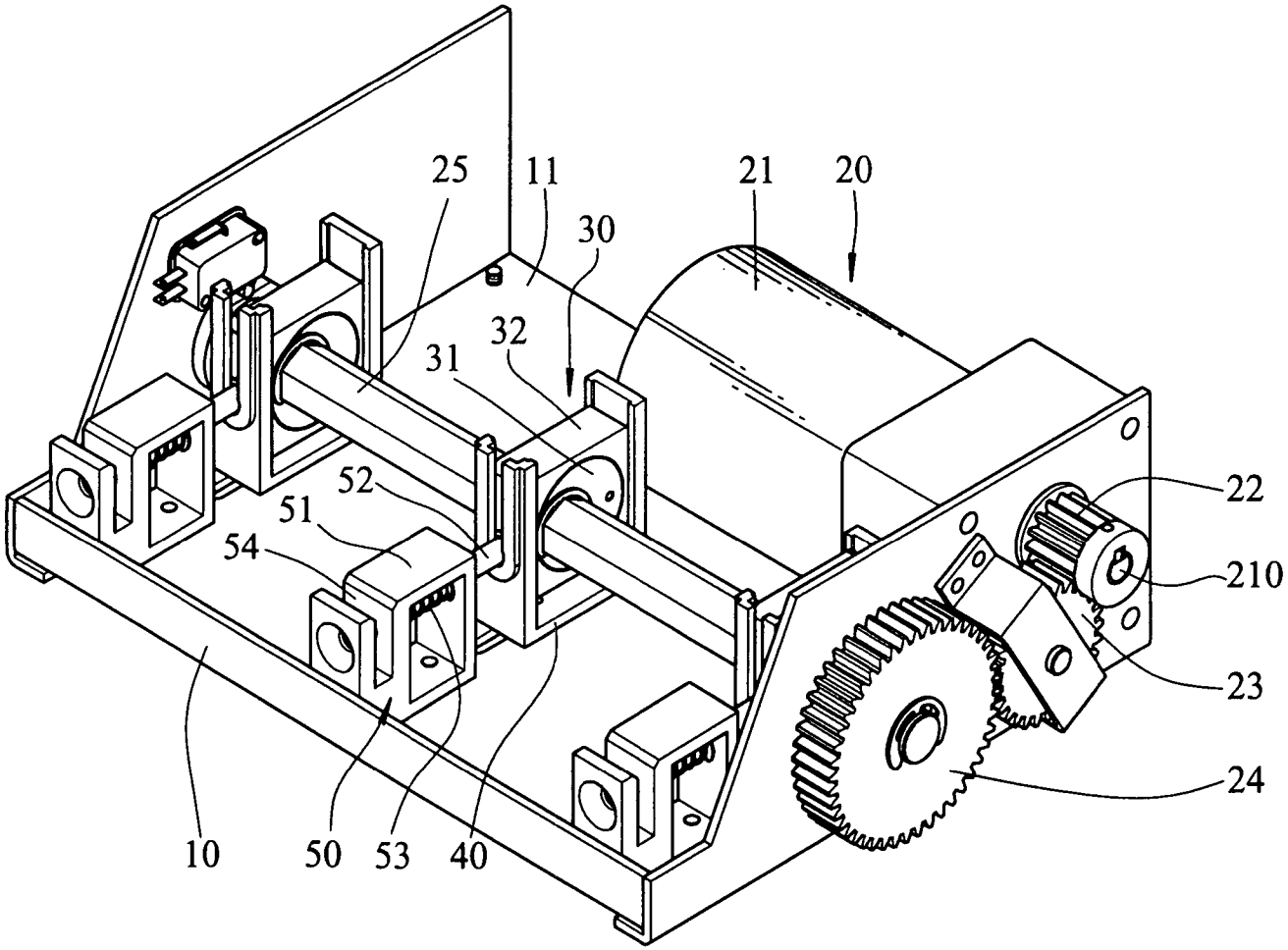
FIG. 1 is a perspective view to show the electric punch of the present invention.
Figure 2:
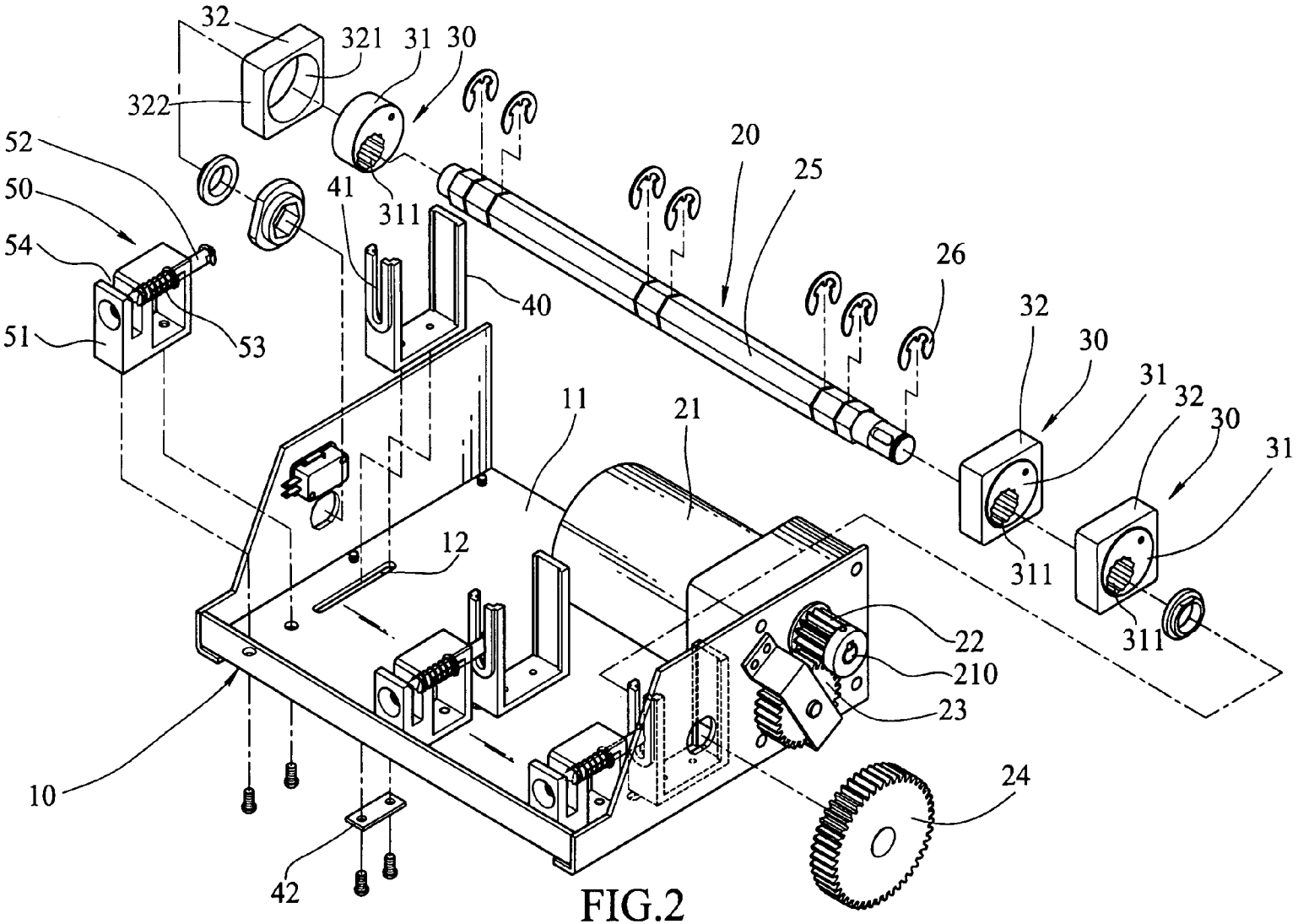
FIG. 2 is an exploded view to show the electric punch of the present invention.
Figure 3:
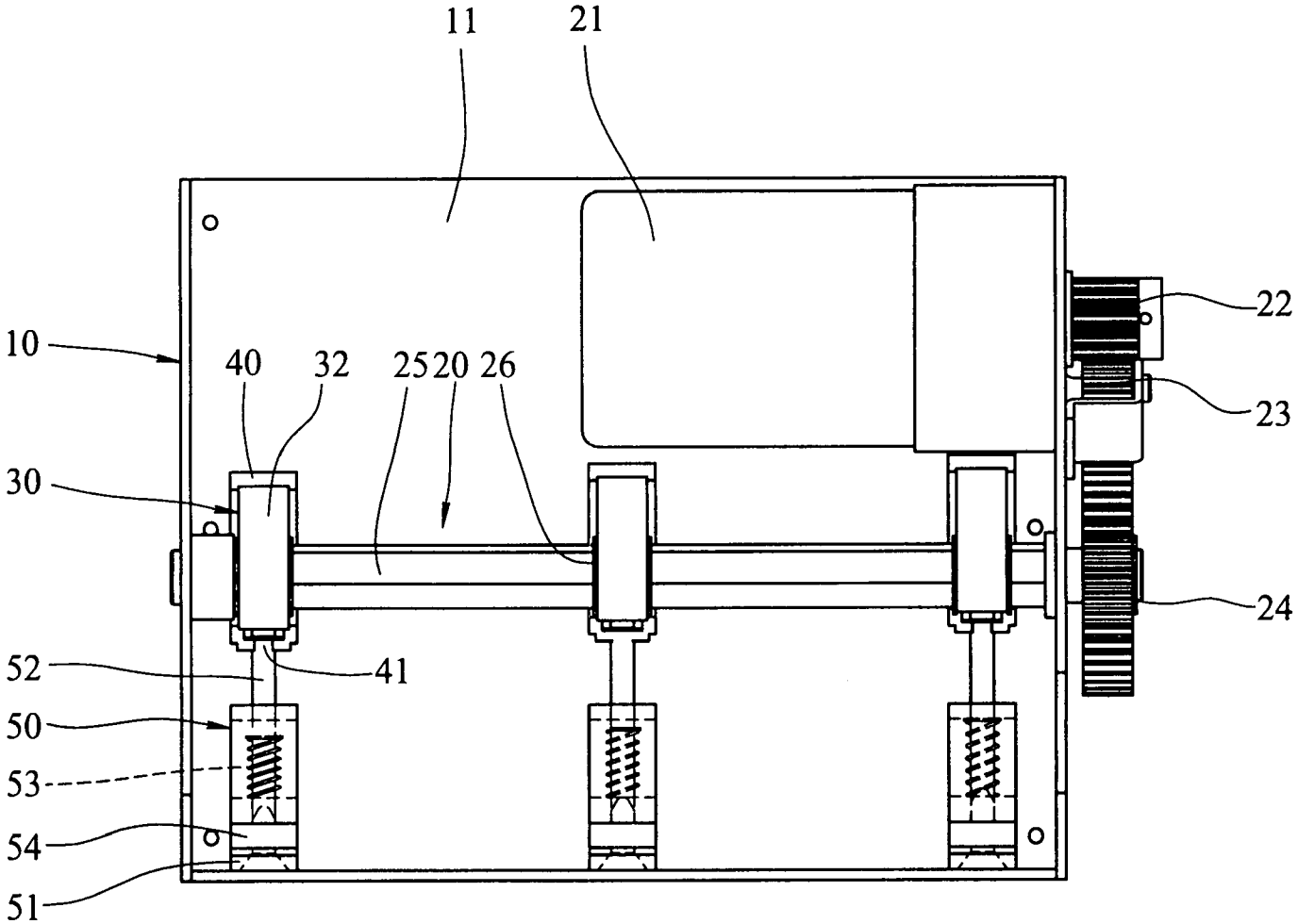
FIG. 3 is a top view to show the electric punch of the present invention.
Figure 4A:
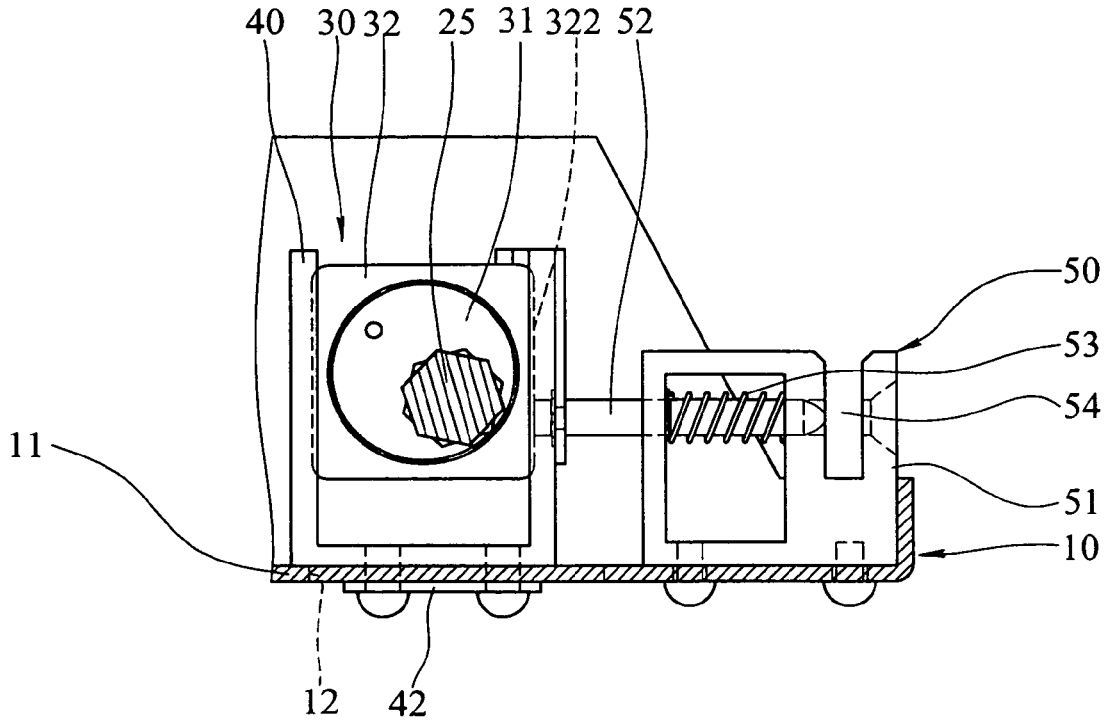
FIGS. 4A to 4D show the continuous actions of the punch member punching through sheets.

Referring to FIGS. 1 to 3 and 4A, the electric punch of the present invention comprises a case 10 with two side walls and a floor board 11 connected between the two side walls. A power source 20 is located on the floor board 11 and includes a motor 21 whose output shaft 210 extends through one of the side walls. A first gear 22 is connected to the output shaft 210. A shaft 25 with a polygonal shank portion is rotatably connected between the two side walls of the case 10 and an active gear 24 is connected to an end of the shaft 25. A second gear 23 is matched between the first gear 22 and the active gear 24, so that the shaft 25 is driven by the motor 21.

A plurality of pushing units 30 are mounted to the shaft 25 and each pushing unit 30 includes a ring 31 and a pushing member 32 which includes a circular hole 321 and the ring 31 is rotatably engaged with the circular hole 321. Each ring 31 has a polygonal hole 311 defined eccentrically therethrough and the shaft 25 fixedly extends through the polygonal holes 311. The pushing units 30 are well positioned by using clips 26. The polygonal hole 311 in each ring 31 includes twelve parallel ridges and grooves defined in an inner periphery thereof so that the shaft 25 can be positioned by engaging its own polygonal shank portion with the grooves and polygonal holes 311 of the rings 31 are positioned at different angular positions relative to the shaft 25.

A plurality of movable frames 40 are movably connected on the floor board 11 at positions where slots 12 are defined. Each movable frame 40 includes two upright walls and a horizontal base which is connected to a plate 42 located at a bottom of the floor board 11 by bolts such that the movable frames 40 is movable within the range of the slots 12. One of the upright walls of each movable frames 40 has a recess 41 defined therein.

A plurality of punch units 50 each include a punch frame 51 and a punch member 52 movably connected between two of three upright walls thereof and a spring 53 is mounted to the punch member 52 so as to keep a rear end of the punch member 52 to extend out from the punch frame 51 corresponding thereto and to movably engaged with the recess 41 of the movable frame 40 corresponding thereto. The punch frames 51 are connected to the case 10 and respectively located in front of the upright wall having the recess 41 of the movable frames 40. The rear end of the punch member 52 movably engaged with the recess 41 of the movable frame 40 is in contact with the pushing member 32. Each punch frame 51 further includes a slot 54 between the front two right walls so as to receive sheets to be punched and a front end of the punch member 52 can be moved through the slot 54. Each pushing member 32 is a rectangle block and two opposite sides 322 of each pushing member 32 are slidably in contact between the two upright walls of the movable frame 40 corresponding thereto, and the rear end of the punch member 52 is in contact with one of the two opposite sides 322 of the pushing member 32.

Figure 4B:
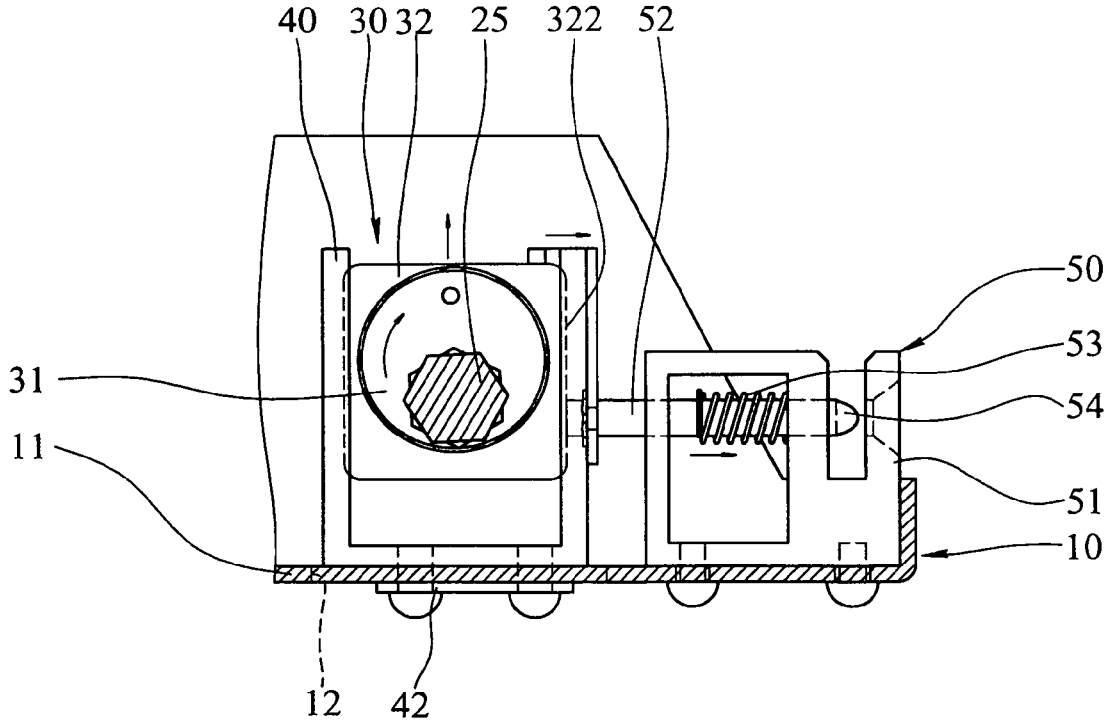
Figure 4C:
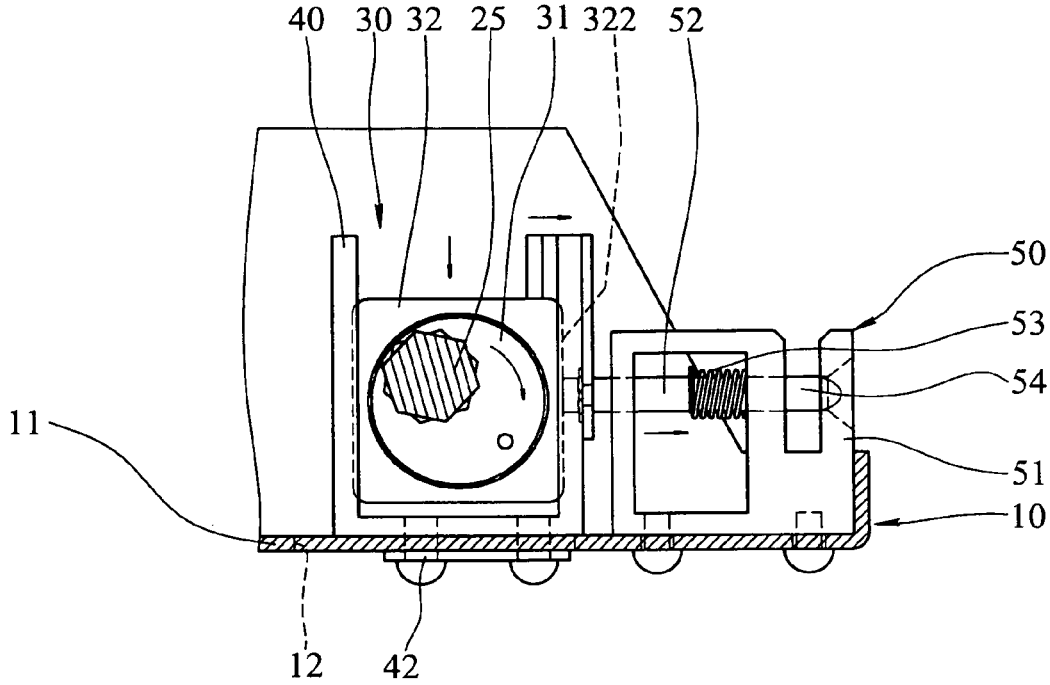
Figure 4D:
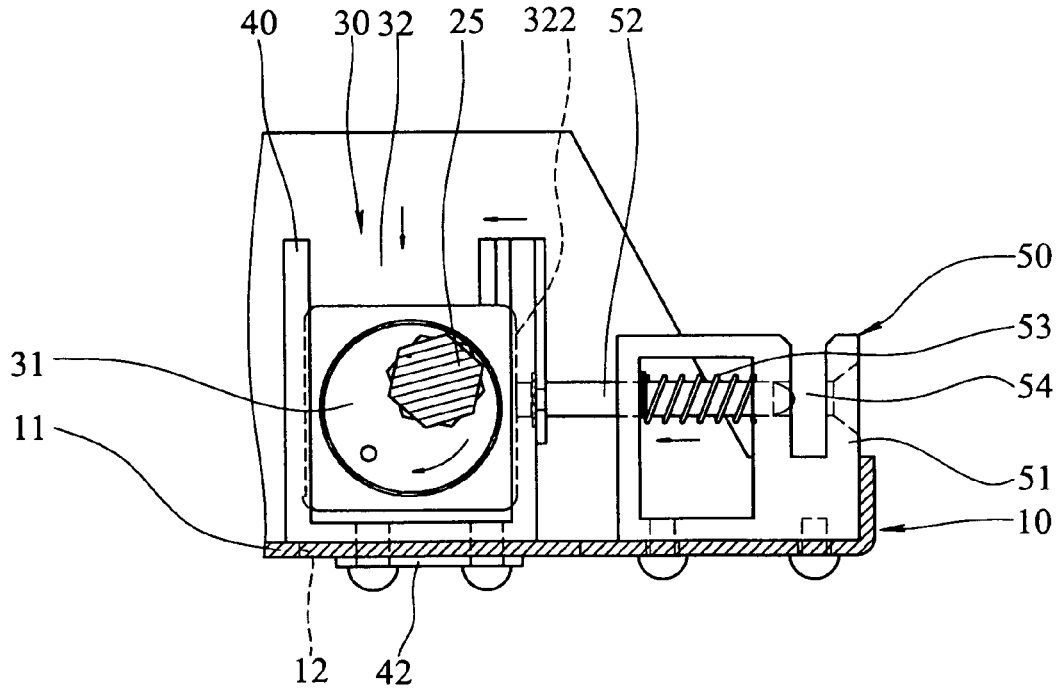
Figure 5:
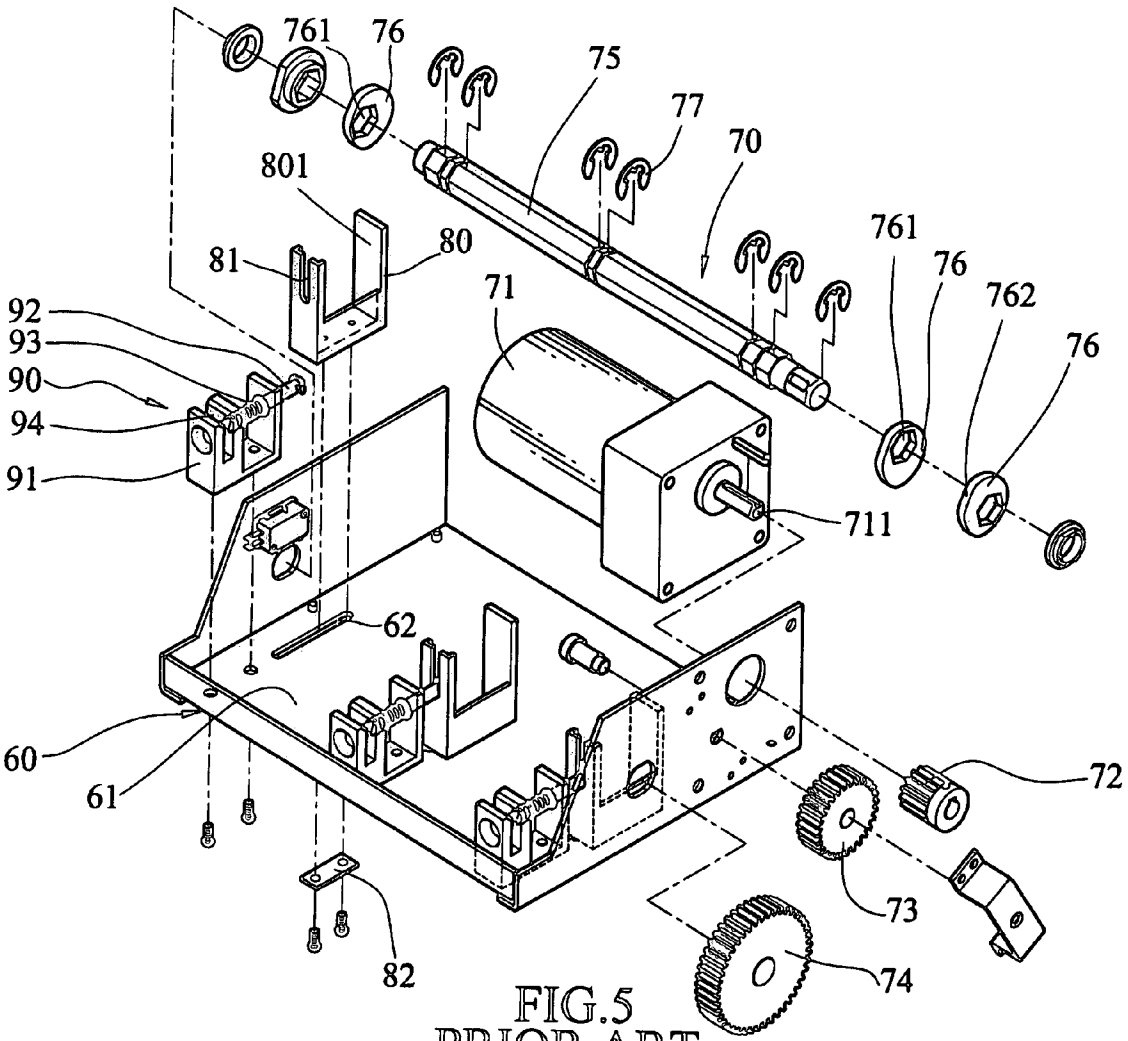
FIG.5 PRIOR ART
FIG. 5 is an exploded view to show a conventional electric punch.
Figure 6:
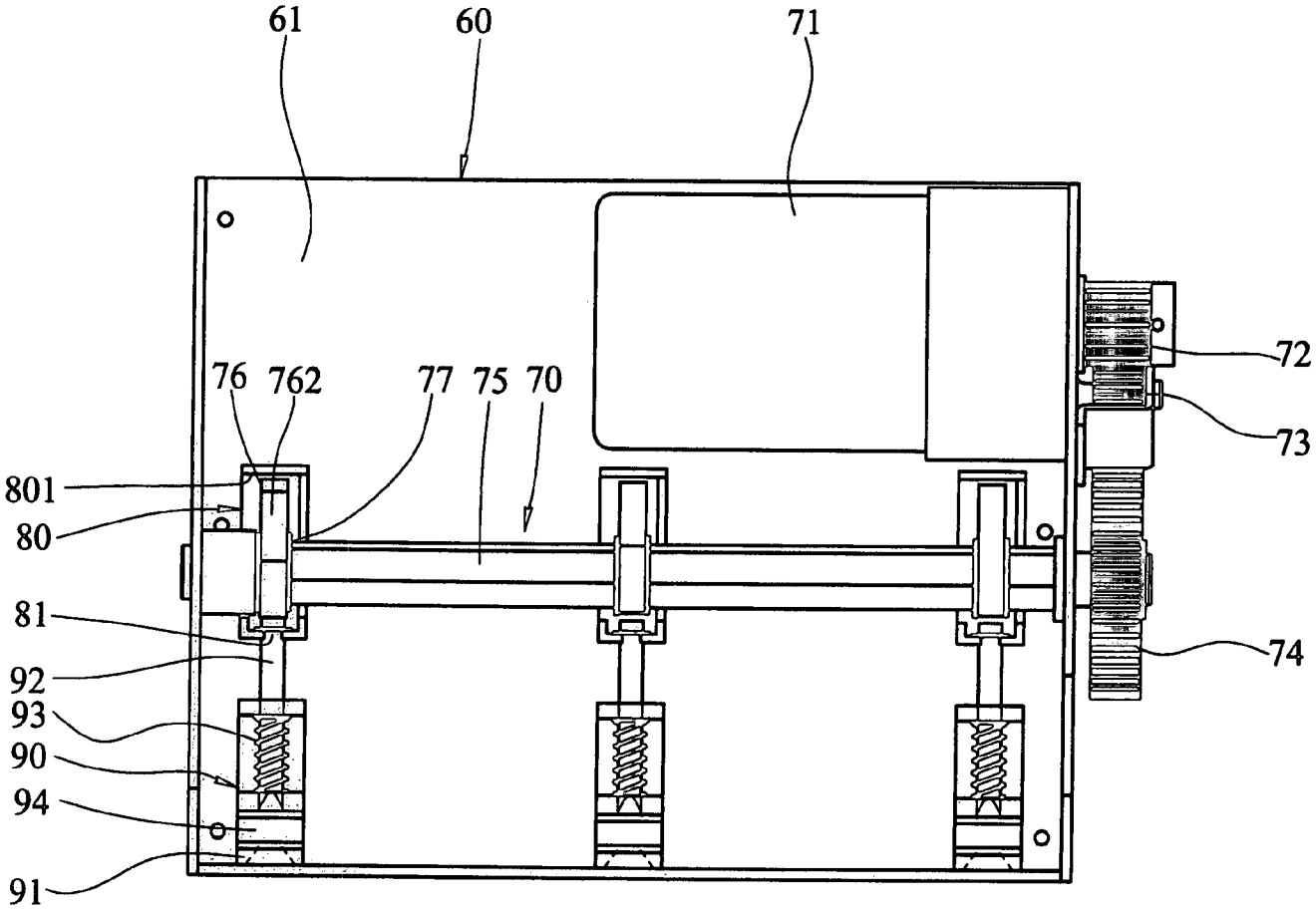
FIG.6 PRIOR ART
FIG. 6 is a top view to show conventional electric punch.
Figure 7A:
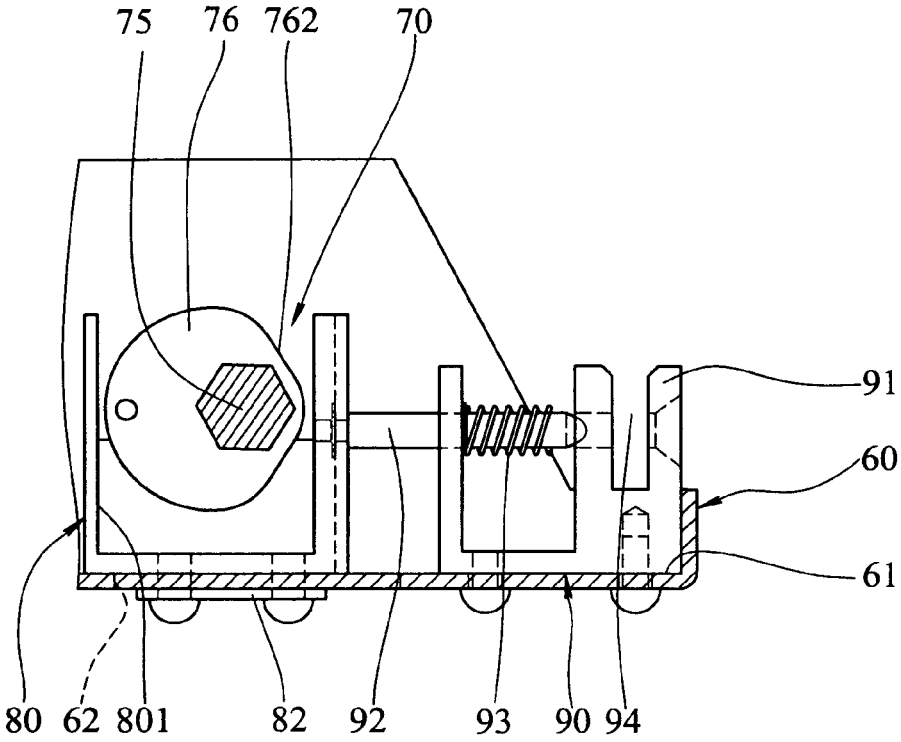
FIG.7A PRIOR ART
FIGS. 7A to 7D show the punching action of the conventional electric punch.
Figure 7B:
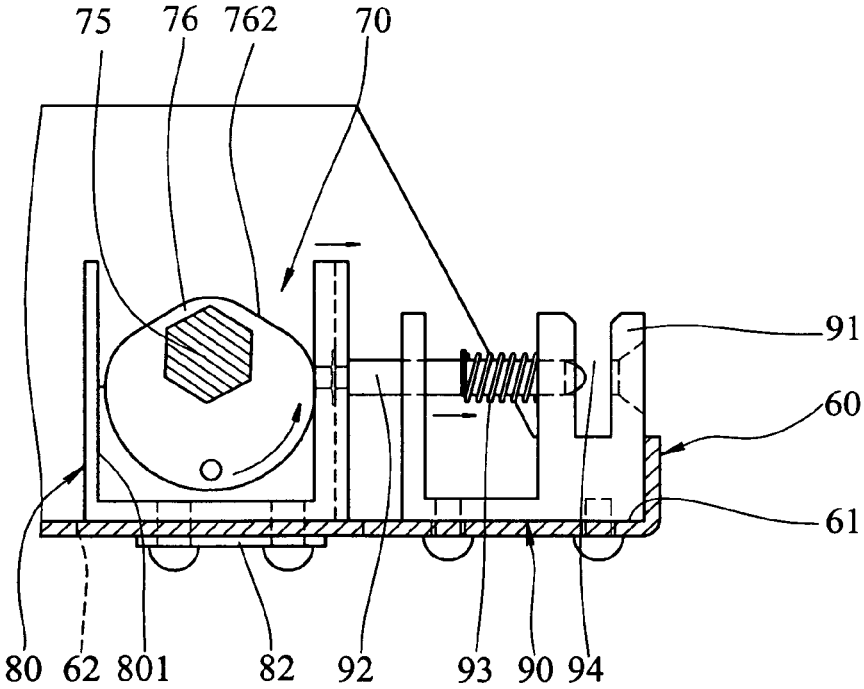
FIG.7B PRIOR ART
Figure 7C:
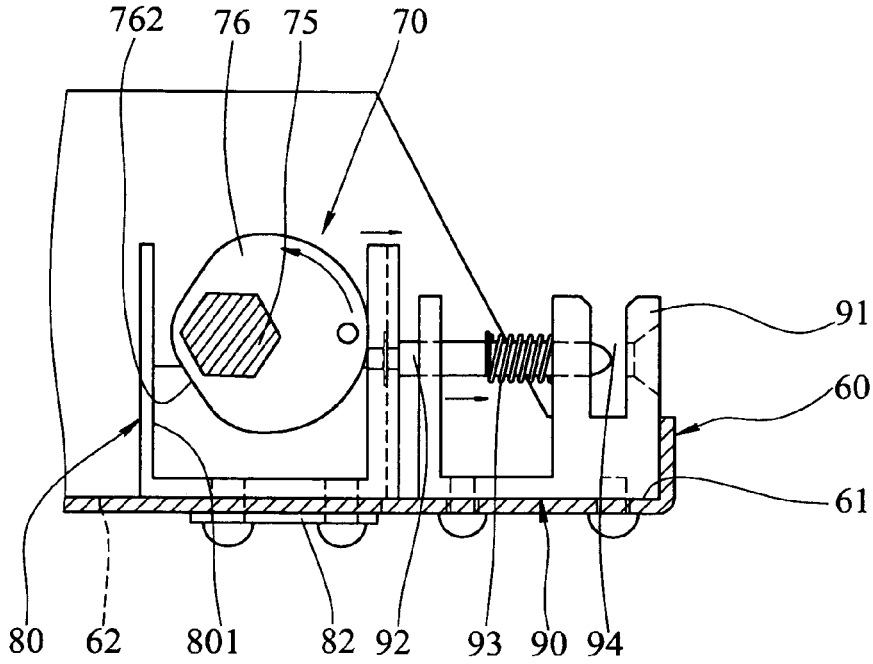
FIG.7C PRIOR ART
Figure 7D:
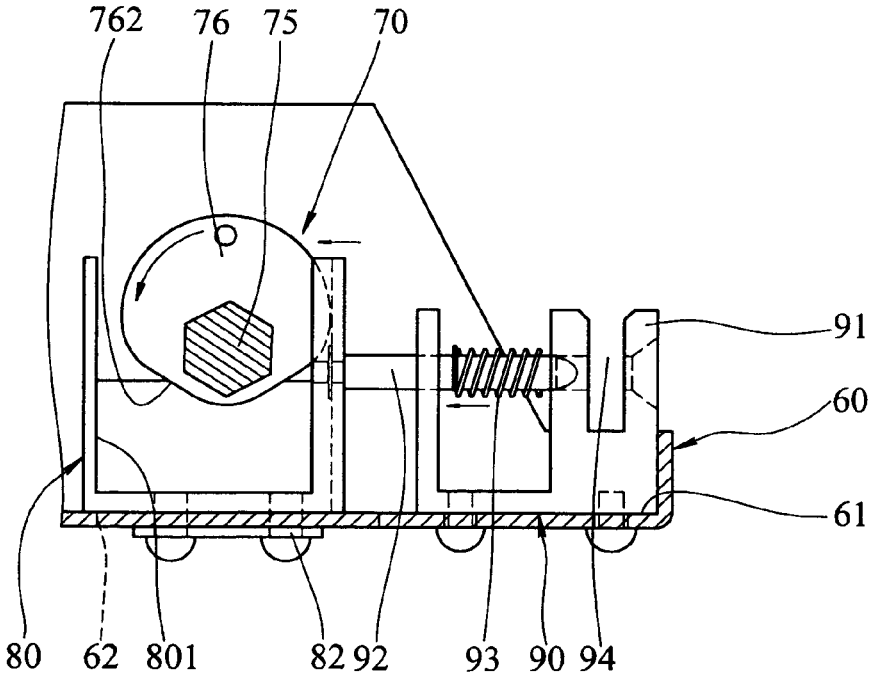
FIG.7D PRIOR ART

Referring to FIGS. 4A to 4D, when the motor 21 is activated, the shaft 25 rotates and drives the rings 31. Because the eccentric polygonal holes 311 are located at different angular positions so that the pushing members 32 are moved in a pre-set sequence. The pushing members 32 can only move up and down between the two upright walls of the movable frames 40 which are moved along the slots 12 to push the punch members 52 to punch the sheets. Because the rear end of the punch members 52 is always in contact with the pushing members 32 so that there will be no noise generated.

While we have shown and described the embodiment in accordance with the present invention, it should be clear to those skilled in the art that further embodiments may be made without departing from the scope of the present invention.

What is claimed is:

1. An electric punch comprising:

a case with two side walls and a floor board connected between the two side walls, a motor located on the floor board and driving a shaft rotatably connected between the two side walls of the case;

a plurality of pushing units mounted to the shaft and each pushing unit including a ring and a pushing member which includes a circular hole and the ring is rotatably engaged with the circular hole, each ring having a polygonal hole defined eccentrically therethrough and the shaft fixedly extending through the polygonal holes;

a plurality of movable frames each including two upright walls and movably connected to the case, one of the upright walls having a recess defined therein; and a plurality of punch units each including a punch frame and a punch member movably connected thereto, a rear end of the punch member extending out from the punch frame corresponding thereto, the punch frames connected to the case and respectively located in front of the upright wall having the recess of the movable frames, the rear end of the punch member movably engaged with the recess of the movable frame corresponding thereto and being in contact with the pushing member, each punch frame including a slot for receiving sheets to be punched and a front end of the punch member capable of moving through the slot.

2. The electric punch as claimed in claim 1, wherein a first gear is connected to an output shaft of the motor and an active gear is connected to an end of the shaft, a second gear being matched between the first gear and the active gear.

3. The electric punch as claimed in claim 1, wherein each pushing member is a rectangle block and two opposite sides of each pushing member are slidably in contact between the two upright walls of the movable frame corresponding thereto, the rear end of the punch member being in contact with one of the two opposite sides of the pushing member.

4. The electric punch as claimed in claim 1, wherein the polygonal hole in each ring includes twelve parallel ridges and grooves defined in an inner periphery thereof.

* * * * *